United States Patent [19]

Klein et al.

[11] 3,985,313

[45] Oct. 12, 1976

[54] REEL SYSTEM

[75] Inventors: Konrad Klein, Dortmund-Wambel; Hans Wladika; Theodor Sevenich, both of Dortmund, all of Germany

[73] Assignee: Hoesch Werke Aktiengesellschaft, Dortmund, Germany

[22] Filed: July 29, 1975

[21] Appl. No.: 600,074

[30] Foreign Application Priority Data

Aug. 2, 1974 Germany ..... 2437237

[52] U.S. Cl. ..... 242/78.1

[51] Int. Cl.[2] ..... B21C 47/02

[58] Field of Search ..... 242/78.1, 78.6, 79, 242/81, 56 A, 67.1 R, 66

[56] References Cited

UNITED STATES PATENTS

| | | | |
|---|---|---|---|
| 3,086,725 | 4/1963 | Zernov | 242/56 A |
| 3,197,154 | 7/1965 | Koreishi | 242/70 |
| 3,598,333 | 8/1971 | Beeman | 242/78.1 |

*Primary Examiner*—Edward J. McCarthy
*Attorney, Agent, or Firm*—Walter Becker

[57] ABSTRACT

A reel system, especially for rolling up strip steel, in which a rotatable housing is provided which has two circumferentially spaced spindles extending therefrom parallel to the axis of the housing, a gear in the housing is provided for each spindle and each spindle can be clutched to the housing or to the respective gear. A motor on the outside of the housing drives a gear meshing with the first mentioned gears while a ring gear on the housing meshes with a motor driven pinion for rotation of the housing. The housing carries clamp arms actuatable for clamping a wound up reel on each spindle. The arrangement permits each spindle to be positioned selectively in reeling up position for winding up a reel while the other spindle is positioned for discharging a reel previously wound up thereon.

8 Claims, 3 Drawing Figures

REEL SYSTEM

The present invention relates to a reel which is journalled in a machine stand and follows a dividing plant for longitudinally dividing hot and cold rolled metal, especially steel bands, for simultaneously winding up the divided bands on a driven winding mandrel.

Plants for longitudinally dividing bands of hot and cold rolled metal, especially steel, are known. Such plants primarily comprise a device for winding off the non-divided band, a device for longitudinally dividing the band, and a device for winding up the longitudinally divided band strips on one axle with devices for withdrawing the wound-up and bound bands. The winding up devices or reels employed in this connection have a reel arranged on a stationary place. Following the winding-up of the longitudinally divided bands on the reel, the band ends of the individual divided bundles are held by a bundle lifting carriage moved below the bundles and are bound up by passing a wrapping band therearound. After all divided bundles have been bound up, the spread reel is relaxed or contracted and the bundles are pulled off the reel. Following the withdrawal of the bundles, the reel can again be spread, and new divided bands may again be wound upon the reel. It is a drawback that during the entire binding operation the dividing plant is at a standstill.

In order to overcome the above mentioned drawback, it has been suggested that during the last binding up phase, the respective band end be temporarily bound up by an adhesive strap. However, also this solution does not represent a satisfactory solution because for instance it still permits the inner windings of the bundle to displace themselves which in turn may considerably delay the pulling-off of the bundle.

Another reeling device has become known for the intake part of temper pass mills in cold rolling works for winding off sheet metal bands which have been rolled into bundles and which are provided with two pivotable reel mandrels which are adapted to be driven independently of each other and are pivotable about a common axis alternately into one working position and a preparing position, while the two reel mandrels are journalled in a pivotal head with horizontal axis parallel to said axis in an overhang fashion and are adapted in both positions to be connected to stationarily arranged driving devices by disengageable clutches.

Due to this construction, with this heretofore known reel, quite a distance exists between the center of the band to be wound up and the center of the bearing journalled for the reel housing. The bending moment for the bearing journal is therefore relatively high so that special supports are necessary for compensating the bending moment. Another drawback of this heretofore known arrangement consists in that the reel mandrels have to be disengaged prior to the pivoting operation and have again to be engaged or coupled following the pivoting operation. The engagement of the large clutches is, however, rather time consuming.

Furthermore there has become known a multi-drum reel for stiff metal bands which follows a rolling mill and an overhang shear and operates in a continuous manner. The individual drums of said reel which timewise are operable one behind the other are adapted by means of a belt-looping device which extends around said drums during the start of the reeling and opens up after a plurality of layers have been placed on said drums and by means of shears cutting the band at the end of the reeling, to receive bundles wound therearound and are furthermore adapted to be imbedded by stripping off said bundles. With this known reel, it is necessary to provide one driving motor each for driving the provided two winding drums. This is due to the drive of the winding mandrels by means of shafts plugged into each other, which is passed through a third shaft to which the reel housing is connected and is rotatably journalled in the reel stand. Such embodiment of the reel is rather expensive and complicated and requires considerable space. In addition thereto, the bearing areas for the rotatable housing are rather far away from the center of the winding mandrels so that the band pull attacks at a long lever arm.

It is an object of the present invention to provide a reel of the above mentioned general type by means of which the binding and withdrawal of the divided bands bound into bundles can be effected simultaneously with the winding up of successive bands, and in which the bending moments caused by the band pull in the reel can be kept low while aligning errors of the reel or winding mandrel will be avoided.

It is another object of the invention to provide a reel as set forth in the preceding paragraph in which a time-consuming coupling and uncoupling of the winding mandrel will not be necessary while the construction of the reeling device will be simple and space-saving.

These and other objects and advantages of the invention will appear more clearly from the following specification in connection with the accompanying drawings, in which.

Figure 1:
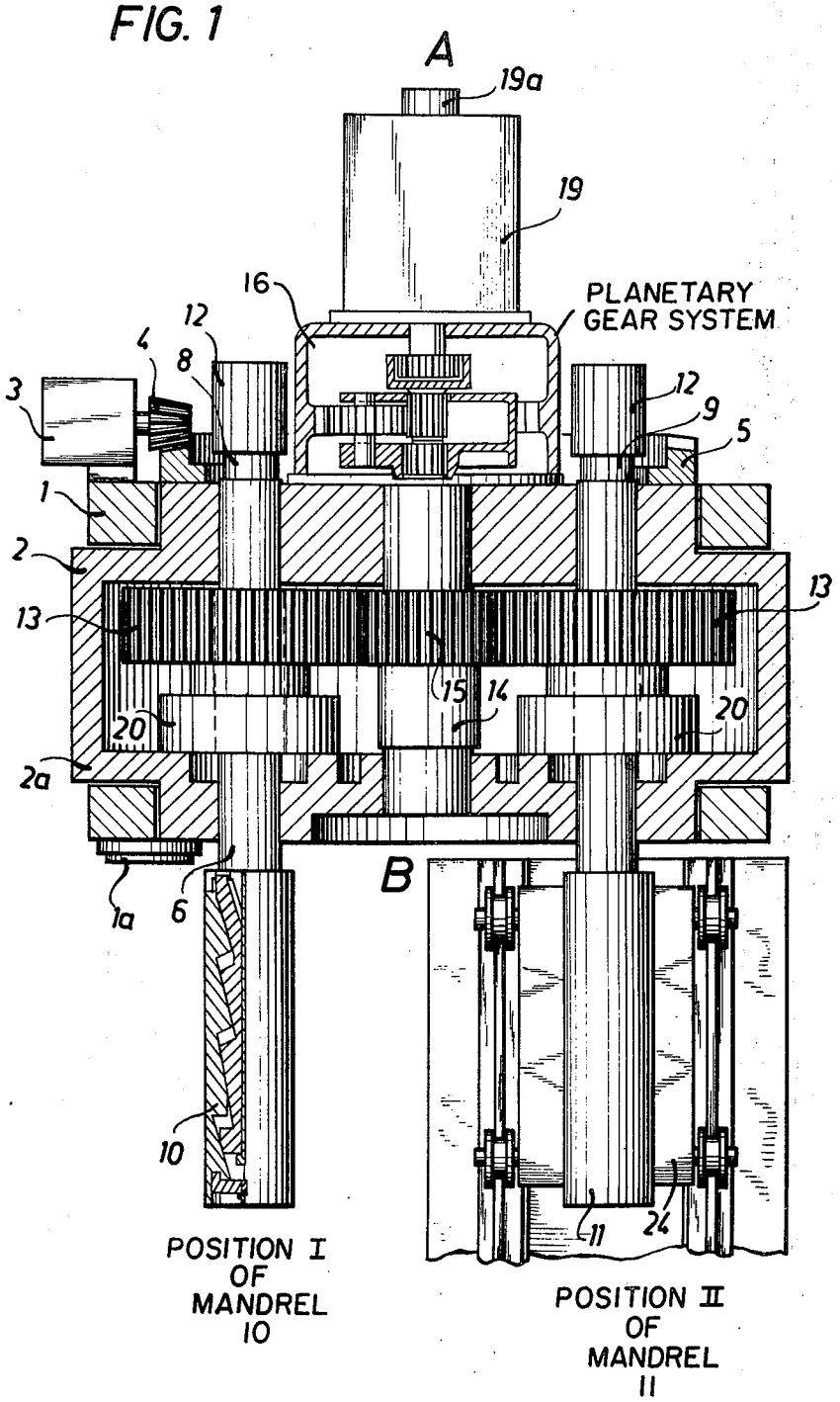
FIG. 1 illustrates a top view of a reeling device according to the present invention.

A reel or reel system according to the present invention is characterized primarily in that in the machine stand there is rotatably journalled on the outer circumference a round housing and there is furthermore provided a driven central shaft which is arranged transversely with regard to the winding direction and centrally in the housing while being provided with a gear. Two additional gears mesh with said first mentioned gear which gears are provided on shafts which are symmetrically arranged with regard to said central shaft and are journalled in said housing while supporting winding mandrels. The above arrangement is furthermore characterized in that a double acting electromagnetic coupling each or a hydraulically controlled clutch each is arranged on said shaft.

According to a further development of the reel system according to the present invention, the central shaft which is journalled in the end wall and rear wall of the housing is through a step-down transmission or planetary gear transmission connected to a driving motor. According to a preferred embodiment of the invention, the step-down transmission and the drive motor are by means of a flange connected to the rear wall of the housing. However, also the planetary gear transmission and the driving motor may by means of a flange be connected to the rear wall of the housing.

Advantageously, with the new reel system according to the invention, the electromagnetic coupling is arranged between the gear and the end face of the housing, which end face has one side of the electromagnetic coupling connected to the gear while its other side is adapted to be connected to the end wall so that the driving or braking fast of the winding mandrel can be carried out at high speed. Advantageously, a transmission motor is provided on the machine stand of the reel, which motor drives the housing through a transmission gear and the gear connected to the housing.

Referring now to the drawings in detail, the reel system shown therein comprises a rigid machine stand 1 in which the closed round housing 2 is rotatably journalled for rotation about a horizontal axis A–B. The housing 2 is driven by means of a transmission motor 3 which is flanged to the stand 1. This drive is effected through a transmission gear 4 and the gear ring 5 connected to the housing 2. By means of a latch 1*a* mounted on the stand 1, the housing 2 is secured against rotation.

On both sides of the horizontal axis A–B in housing 2 and symmetrically in bearings 6,7 there are journalled the shafts 8,9 on which on one hand one winding mandrel 10,11 each is arranged for winding up the band and on the other hand there is arranged a spreadable cylinder 12 for spreading and upspreading the winding mandrels 10,11. In the interior of housing 2, and more specifically on shafts 8,9 there is arranged a gear wheel 13 each meshing with the teeth of a further gear 15 arranged on the central shaft 14. One end of the central shaft 14 is journalled on the end face 2*a* of the housing 2, whereas the other end of the intermediate shaft 14 is passed through the rear wall 2*b* of the housing 2 and is connected to a step-down transmission 17 (FIG. 2) by means of a clutch 18. Instead of a step-down transmission, also a planetary gear transmission 16 (FIG. 1) may be employed. The transmission 16,17 is driven by a motor 19. The transmission 16,17 and the motor 19 are by means of flange 17*a*, 17*b* flanged directly to the rear walls 2*b* of housing 2. Thus, by means of the motor 19 through the intervention of the central shaft 14 and gears 13 the shafts 8 and 9 are driven. However, if desired, also the transmissions 16,17 and the motor 19 may be provided on the machine stand 1.

On shaft 8,9 there is further provided a double acting electromagnetic clutch 20 and more specifically between the gear 13 and the end face wall 2*a* of the housing 2. The center of the clutch 20 is connected to the mandrel shaft 8,9 whereas selectively one side of the clutch 20 is adapted to be clutched to the housing 2 whereas the other side is adapted to be clutched to the gear 13.

For purposes of holding the ends of the finish wound bundles, there are provided pivotable arms 22 which are associated with the winding drums 10,11, which are connected to the housing 2 and are pivotable about a shaft 21. The arms 22 are adapted by means of a hydraulic cylinder piston system 23 and a lifting magnet to be pressed against the band ends. The supply of current for the drive and the spreading and upspreading of the winding mandrels 10,11 as well as for the holding device 21–23 for the band ends is effected through the intervention of a sliding ring or collector body 19*a* which is arranged on the axle of the drive motor 19.

The finish wound and bound bundles are by means of a lifting carriage 24 pulled off from the winding mandrel 11. The lifting carriage 24 is movable on rails 24 in the direction of the axle of the winding mandrel 11.

Figure 2:
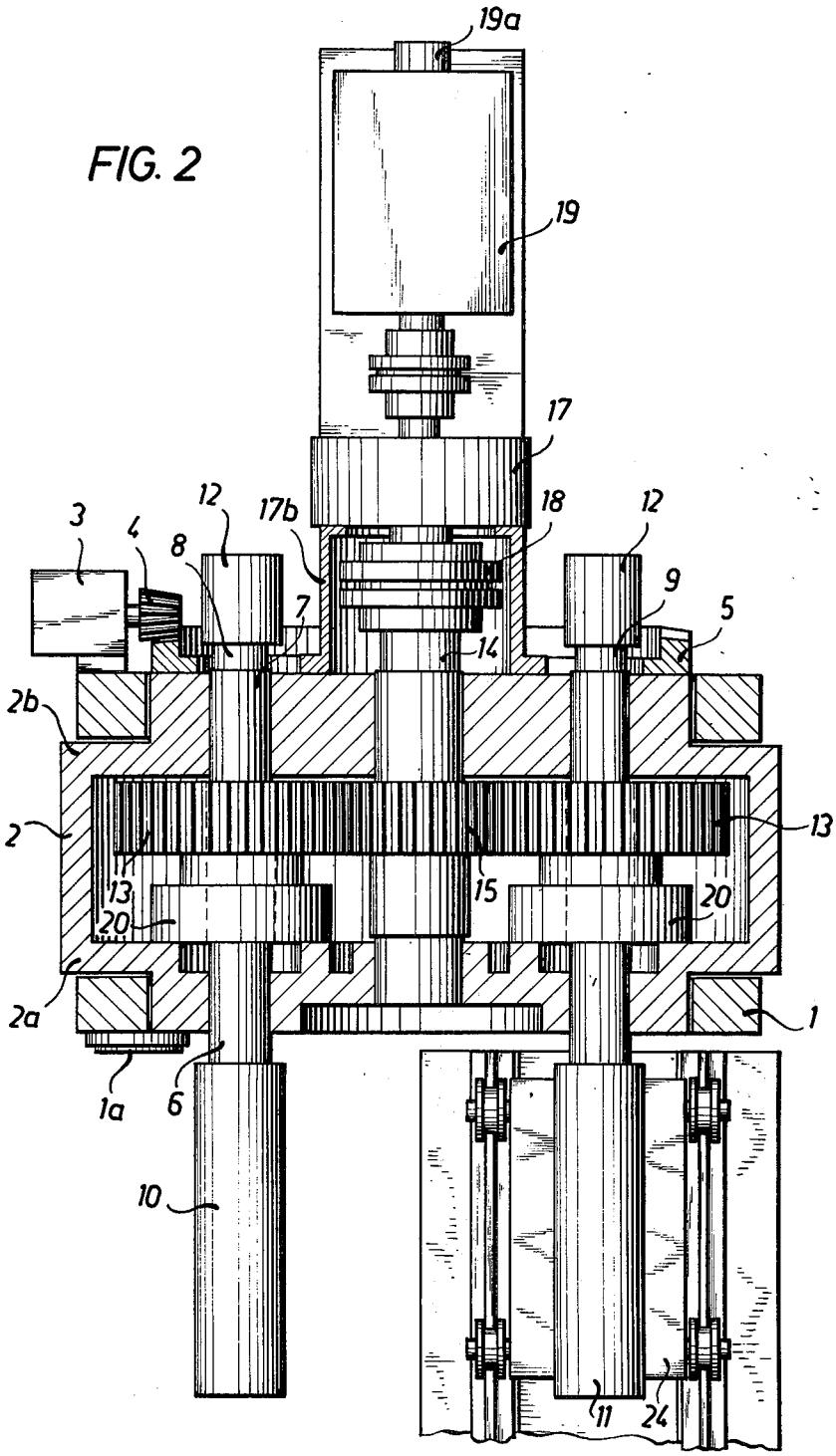
FIG. 2 represents a modification in a section through the reeling device of the present invention.
Figure 3:
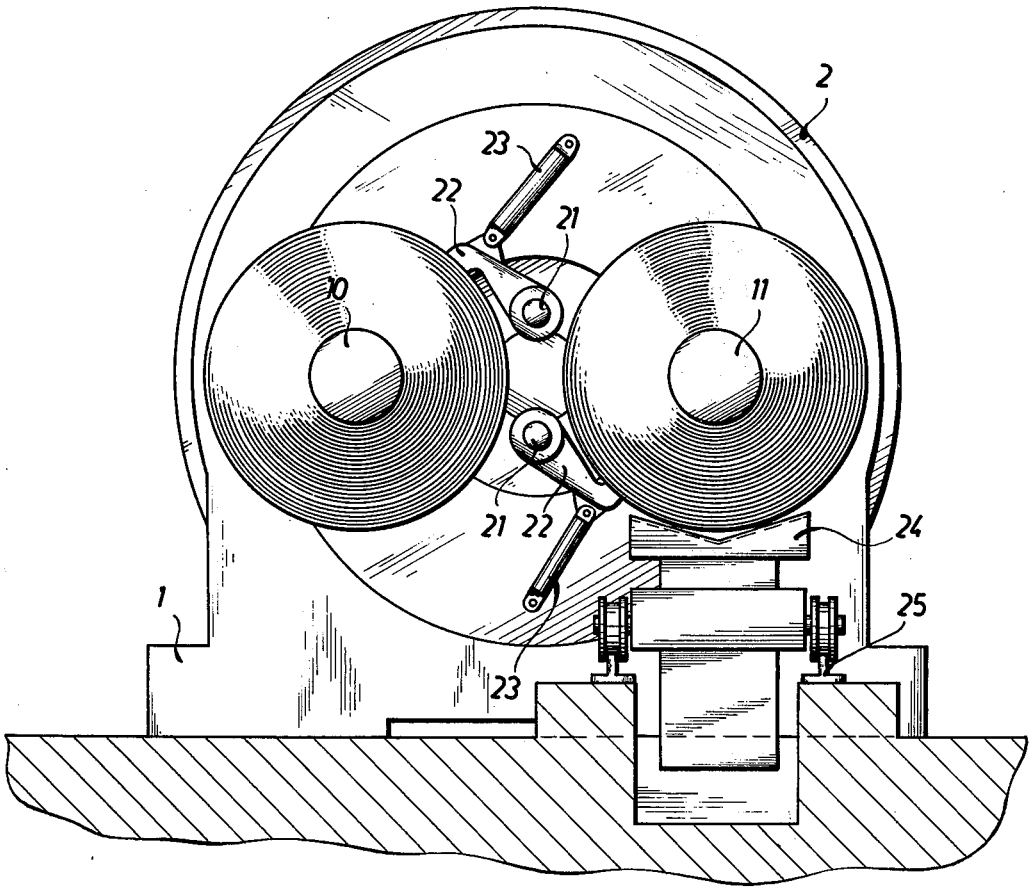
FIG. 3 represents a side view of the device of FIGS. 1 and 2.

With the reel systems illustrated in FIGS. 1–3, the winding mandrel 10 occupies a position in which the band is being wound up (Position I) whereas the winding mandrel 11 occupies a position in which the wound up bands are bound (Position II). When bands are being wound onto the winding mandrel 10, the shaft 8 is through the intervention of the electromagnetic clutch 20 coupled to the gear 15 on the central shaft 4 and therefore is being driven. At the same time, the shaft 9 is through the pertaining electromagnetic clutch 20 clutched to the housing 2 and is therefore braked. During the winding of bands onto the winding mandrel 10, it will be appreciated that the already wound bands on the winding mandrel 11 are bound by passing a packing band therearound. These bundles are held by arms 22 and the hydraulic cylinder piston system 23. When the bundles have been completely bound, the winding mandrel 11 is de-spread or contracted as made possible due to interaction of parts represented by partial sectioning of mandrel 10 in FIG. 1.

As soon as the bands have been completely wound upon the winding mandrel 10, the winding mandrel having the bands wound thereupon is by turning the housing 2 about the axis A–B or the central shaft 14 moved from Position I to Position II and vice versa; the empty winding mandrel 11 is moved from the Position II to Position I. After this exchange of the winding mandrels 10,11 and the engagement and disengagement with and from the gear 15 and to and from the housing 2, the winding can immediately thereupon again be effected in Position I, and in Position II the binding action can be effected.

As will be evident from the above, the advantage of the reel system according to the invention consists primarily in that the invention makes it possible simultaneously to wind up divided reel bands on one reel and to bind as well as pull off the bound bundles while the bending moments which are created in the reel by the band pull will in view of the short lever arms from the point of attack of the band pull to the machine stand be kept very small so that an additional support of the housing is not necessary.

Furthermore, aligning errors of the reel and winding mandrel will be avoided, and the time consumption for the clutching and unclutching of the winding mandrels to the drive is reduced to a minimum. Thus, a reel system of an extremely simple construction and characterized by its space-saving for a simutaneous winding and binding of divided bands on one winding drum each is obtained.

It is, of course, to be understood that the present invention is, by no means, limited to the specific showing in the drawings, but also comprises any modifications within the scope of the appended claims.

What is claimed is:

1. In an apparatus for reeling up strip material, especially steel strip, and for unloading wound up reels therefrom; a frame, a housing rotatable in the frame and having a pair of winding up spindles journaled therein in spaced parallel relation and extending axially from one side of the housing, a shaft rotatable in the housing on the axis of rotation of the housing and having a drive gear fixed thereto in said housing, a driven gear in the housing for each spindle and meshing with the said drive gear, a clutch in the housing for each spindle each having a first position in which the respective spindle is clutched to the housing and is unclutched from the pertaining driven gear and a second position in which the respective spindle is clutched to the respective gear and is unclutched from the housing, and means for rotating said housing about the axis of said drive gear to present said spindles selectively one to winding up position and the other to unloading position.

2. An apparatus according to claim 1 which includes a drive motor for said shaft and speed reducing transmission means connecting the motor to the shaft.

3. An apparatus according to claim 1 which includes a drive motor for said shaft and speed reducing transmission means connecting the motor to the shaft, and flange means supporting said motor and transmission on the side of said housing opposite said spindles.

4. An apparatus according to claim 1 which includes a drive motor for said shaft and speed reducing transmission means connecting the motor to the shaft, and flange means supporting said motor and transmission on the side of said housing opposite said spindles, said speed reducing transmission means comprising a planetary gear system.

5. An apparatus according to claim 1 in which each clutch has one part fixed to the pertaining spindle and a second part drivingly connected to the said first part and movable selectively into engagement with the respective driven gear and with said housing.

6. An apparatus according to claim 1 which includes a ring gear on the housing, and a motor on said frame having a pinion meshing with said ring gear for rotating the housing in the frame.

7. An apparatus according to claim 1 which includes clamp arms tiltably mounted on said housing and each operable for clamping a reel on a respective spindle, and actuators connected between the arms and housing and operable for selectively actuating said arms between reel clamping and reel unclamping positions on said housing.

8. An apparatus according to claim 1 which includes collector means on the axis of said housing adapted for effecting control functions in response to rotation of said housing in said frame.

* * * * *